US010570356B2

(12) United States Patent
Piorkowski

(10) Patent No.: US 10,570,356 B2
(45) Date of Patent: Feb. 25, 2020

(54) SINGLE DOSE LAUNDRY DETERGENT PACKS HAVING ZINC RICINOLEATE AND SODIUM IMINODISUCCINATE

(71) Applicant: Henkel IP & Holding GmbH, Duesseldorf (DE)

(72) Inventor: Daniel T. Piorkowski, Fairfield, CT (US)

(73) Assignee: Henkel IP & Holding GmbH (DE)

( * ) Notice: Subject to any disclaimer, the term of this patent is extended or adjusted under 35 U.S.C. 154(b) by 26 days.

(21) Appl. No.: 16/014,148

(22) Filed: Jun. 21, 2018

(65) Prior Publication Data

US 2019/0390144 A1 Dec. 26, 2019

(51) Int. Cl.

| | |
|---|---|
| ***C11D 3/00*** | (2006.01) |
| ***C11D 17/00*** | (2006.01) |
| ***C11D 17/04*** | (2006.01) |
| ***C11D 3/20*** | (2006.01) |
| ***C11D 3/33*** | (2006.01) |

(52) U.S. Cl.
CPC ..... *C11D 17/042* (2013.01); *C11D 3/2086* (2013.01); *C11D 3/33* (2013.01)

(58) Field of Classification Search
CPC ..... C11D 1/00; C11D 3/26; C11D 3/43
See application file for complete search history.

(56) References Cited

U.S. PATENT DOCUMENTS 6,979,669 B2 * 12/2005 Raehse ..... C11D 3/0068 252/186.25
8,318,806 B2 11/2012 Mabrouk
2009/0092568 A1 * 4/2009 Mabrouk ..... A61K 8/27 424/67
2011/0045237 A1 * 2/2011 Ripley ..... B44C 1/228 428/131
2015/0376550 A1 12/2015 Ohtani et al.
2019/0040338 A1 * 2/2019 Paranjpe ..... C11D 3/2086

FOREIGN PATENT DOCUMENTS

DE 102006013614 A1 9/2007
WO 0212423 A2 2/2002

OTHER PUBLICATIONS

Extended European Search Report EP 19168084.2 Completed; Oct. 15, 2019 dated Oct. 21, 2019 10 pages.

* cited by examiner

*Primary Examiner* — Mark Kopec
(74) *Attorney, Agent, or Firm* — Bojuan Deng

(57) ABSTRACT

A single dose pack includes a container including a water-soluble film and a single dose laundry detergent composition encapsulated within the container. The single dose laundry detergent composition includes about 0.01 to about 0.5 weight percent of zinc ricinoleate based on a total weight of the composition, about 0.07 to about 2.7 weight percent of sodium iminodisuccinate based on a total weight of the composition, and about 2.7 to about 35 weight percent of a non-aqueous solvent based on a total weight of the composition. The composition also includes water and about 35 to about 75 weight percent of a surfactant based on a total weight of the composition. The composition has a water activity of from about 0.45 to about 0.8 measured at about 25° C. and has a turbidity of less than about 25 NTU measured after ageing at about 75° F. for about 24 hours.

20 Claims, No Drawings

SINGLE DOSE LAUNDRY DETERGENT PACKS HAVING ZINC RICINOLEATE AND SODIUM IMINODISUCCINATE

TECHNICAL FIELD

The present disclosure generally relates to a single dose pack that includes a laundry detergent composition, and methods of forming both the composition and the pack. More specifically, the single dose laundry detergent composition includes zinc ricinoleate and sodium iminodisuccinate.

BACKGROUND

There is a great need for deodorizing compositions suitable for use in laundry applications. Some deodorants conceal unpleasant odors through the addition of perfumes. Others utilize antimicrobial active ingredients. Still others utilize odor absorbers which can chemically or physically bond the odor-forming compounds by adsorption or absorption, respectively. One representative of such an odor absorber is a zinc salt of ricinoleic acid, such as zinc ricinoleate.

Zinc ricinoleate can chemically bond to odor-intensive organic substances with sulfur or nitrogen containing functional groups such as mercaptans, thioethers, low molecular weight carboxylic acids, such as isovaleric acid, as well as amines. The ability of zinc ricinoleate to chemically bond to substances of this type and negate their odor causing potential permits zinc ricinoleate to be used in many areas of application. However, due to its polymeric salt structure, zinc ricinoleate can only be used directly to a limited degree. Zinc ricinoleate is a compound which is only sparingly soluble in customary solvents, including water. In order to obtain effective preparations, zinc ricinoleate must be used in combination with solvents, surfactants, and solubility promoters. The typical solvents used are mono- or polyhydric alcohols in the presence of high amounts of water. Customarily used highly ethoxylated solubility promoters are unable, even in high concentrations, to keep the zinc ricinoleate in solution.

In the past, hydrolyzed ene-adducts of ricinic fatty acids and maleic anhydride have been used. In addition, other promoters that have been used include partial esters of di- or polyhydroxyalkanes, mono- and disaccharides, polyethylene glycols or alkanolamines with the ene adducts of maleic anhydride formed onto at least monounsaturated carboxylic acids with a chain length of from 10 to 25 carbon atoms and acid numbers from 10 to 140, which are preferably buffered to pH values around 6.5 with amino and/or amido compounds, such as triethanolamine, or glycol esters of aspartic acid and of glutamic acid as a result of the formation of salt-like bonds. Preparations with these solubility promoters tend to be cloudy and result in precipitation of individual components even at very low water levels.

Currently, there is no known solution for utilizing zinc ricinoleate in single dose laundry detergent compositions due to flocculation and sedimentation of the zinc ricinoleate when added over 0.005% by weight on an active basis. This instability worsens when samples are placed into elevated temperature stability. Many commercial suppliers such as Burlington Chemical (Burco DEO 51 NM), ICT Chemicals (Flexisorb OD-300), and Evonik (Tego Sorb A30, Tego Sorb Conc 50) provide chemicals that include 30 to 50% by weight zinc ricinoleate with the other 50 to 70% being a proprietary mixture of water, surfactants, and other solvents.

However, even at a use level of 0.005% active of zinc ricinoleate in a unit dose, the zinc ricinoleate is unstable and settles out of solution within days at temperatures above 100° F. and weeks at room temperature.

Without intending to be bound by any particular theory, it is believed that the primary driver of instability in such compositions is water content, i.e., water activity, which is extremely restricted in unit dose compositions as compared to other compositions. There simply is not enough available water to solvate the zinc ricinoleate in unit dose compositions versus other higher water content compositions. For example, although zinc ricinoleate can be used in compositions that have high water activities above about 0.95, such as High Density Detergents (HDD) laundry in a bottle compositions, it has not been shown to be able to be used in compositions having low water activities less than about 0.8, for the aforementioned reasons.

Accordingly, there remains an opportunity to develop a single dose laundry detergent composition that includes zinc ricinoleate and that performs well. Furthermore, other desirable features and characteristics of the present disclosure will become apparent from the subsequent detailed description of the invention and the appended claims, taken in conjunction with the accompanying drawings and this background of the disclosure.

SUMMARY

This disclosure provides a single dose pack that includes a container including a water-soluble film and a single dose laundry detergent composition encapsulated within the container. The single dose laundry detergent composition includes about 0.005 to about 0.5 weight percent of zinc ricinoleate based on a total weight of the composition, about 0.07 to about 2.7 weight percent of sodium iminodisuccinate based on a total weight of the composition, and about 2.7 to about 35 weight percent of a non-aqueous solvent based on a total weight of the composition. The composition also includes water and about 35 to about 75 weight percent of a surfactant based on a total weight of the composition. The composition has a water activity of from about 0.45 to about 0.8 measured at about 25° C. and has a turbidity of less than about 25 NTU measured after ageing at about 75° F. for about 24 hours.

This disclosure also provides the single dose laundry composition itself and a method of forming the single dose laundry detergent composition. The method includes the step of combining zinc ricinoleate, sodium iminodisuccinate, the non-aqueous solvent, water, and the surfactant to form the single dose laundry detergent composition.

It is unexpectedly discovered that the use of zinc ricinoleate together with sodium iminodisuccinate, in particular amounts, stabilizes zinc ricinoleate in the single dose packs, allowing the incorporation of a higher concentration of zinc ricinoleate in the unit dose composition while maintaining the unit dose composition having low turbidity. The additional incorporation of a non-aqueous solvent further produces compositions that surprisingly have low turbidity, especially as compared to compositions that include higher amounts of sodium iminodisuccinate. Moreover, these compositions can surprisingly undergo ageing at high temperatures and remain usable with low turbidities.

DETAILED DESCRIPTION

The following detailed description is merely exemplary in nature and is not intended to limit the disclosure. Furthermore, there is no intention to be bound by any theory presented in the preceding background or the following detailed description.

Embodiments of the present disclosure are generally directed to single dose laundry detergent compositions and methods for forming the same. For the sake of brevity, conventional techniques related to single dose laundry detergent compositions may not be described in detail herein. Moreover, the various tasks and process steps described herein may be incorporated into a more comprehensive procedure or process having additional steps or functionality not described in detail herein. In particular, various steps in the manufacture of single dose laundry detergent compositions are well-known and so, in the interest of brevity, many conventional steps will only be mentioned briefly herein or will be omitted entirely without providing the well-known process details.

Single Dose Pack:

This disclosure also provides a single dose pack that includes a container including a water-soluble film and a single dose laundry detergent composition encapsulated within the container, each as described below.

A single dose pack can be formed by encapsulating the single dose laundry detergent composition within a container, wherein the container includes a film. In some embodiments, the film forms one half or more of the container, where the container may also include dyes, print, or other components in some embodiments. In some embodiments, the film is water soluble such that the film will completely dissolve when an exterior of the film is exposed to water, such as in a washing machine typically used for laundry. When the film dissolves, the container is ruptured and the contents are released. As used herein, "water soluble" means at least 2 grams of the solute (the film in one example) will dissolve in 5 liters of solvent (water in one example,) for a solubility of at least 0.4 grams per liter (g/1), at a temperature of 25 degrees Celsius (° C.) unless otherwise specified. Suitable films for packaging are completely soluble in water at temperatures of about 5° C. or greater.

In various embodiments, the film is desirably strong, flexible, shock resistant, and non-tacky during storage at both high and low temperatures and high and low humidities. In one embodiment, the film is initially formed from polyvinyl acetate, and at least a portion of the acetate functional groups are hydrolyzed to produce alcohol groups. The film may include polyvinyl alcohol (PVOH), and may include a higher concentration of PVOH than polyvinyl acetate. Such films are commercially available with various levels of hydrolysis, and thus various concentrations of PVOH, and in an exemplary embodiment the film initially has about 85 percent of the acetate groups hydrolyzed to alcohol groups. Some of the acetate groups may further hydrolyze in use, so the final concentration of alcohol groups may be higher than the concentration at the time of packaging. The film may have a thickness of from about 25 to about 200 microns (μm), or from about 45 to about 100 μm, or from about 75 to about 90 μm in various embodiments. The film may include alternate materials in some embodiments, such as methyl hydroxy propyl cellulose and polyethylene oxide.

The single dose pack may be formed from a container having a single section, but the single dose pack may be formed from containers with two or more different sections in alternate embodiments. In embodiments with a container having two or more sections, the contents of the different sections may or may not be the same.

Single Dose Laundry Detergent Composition

This disclosure provides the single dose laundry detergent composition, first introduced above and hereinafter referred to as a composition. The composition may be, include, or consist essentially of, zinc ricinoleate, sodium iminodisuccinate, a non-aqueous solvent, water, and a surfactant, e.g. in any one or more of the amounts described in greater detail below.

In one embodiment, the composition includes the zinc ricinoleate, sodium iminodisuccinate, non-aqueous solvent, water, and surfactant.

In another embodiment, the composition consists essentially of the zinc ricinoleate, sodium iminodisuccinate, non-aqueous solvent, water, and surfactant.

In further embodiments, the compositions is free of, or includes less than 1, 0.5, 0.1, 0.05, or 0.01, weight percent of, any one or more of the optional components or additives described below and/or those such as, but not limited to, solubilizing agents, malodor-control agents, perfumes, slip agents, binders, colorants, etc.

Zinc Ricinoleate

The zinc ricinoleate is present in the composition in an amount of from about 0.005 to about 0.5 weight percent of based on a total weight of the composition. In various embodiments, the zinc ricinoleate is present in an amount of from about 0.005 to about 0.05 weight percent based on a total weight of the composition or of from about 0.007 to about 0.015 weight percent based on a total weight of the composition. In still other embodiments, the zinc ricinoleate is present in an amount of from about 0.01 to about 0.02, from 0.01 to about 0.03, from about 0.01 to about 0.04, from about 0.01 to about 0.05, from about 0.005 to 0.010, from about 0.010 to about 0.05, from 0.1 to 0.5, etc., by weight percent of based on a total weight of the composition. In various non-limiting embodiments, all values, both whole and fractional, between and including all of the above, are hereby expressly contemplated for use herein.

The zinc ricinoleate may be utilized in a pure form, as a mixture, or in a solution, e.g. a 30 to 50% by weight solution of zinc ricinoleate with the other 50 to 70% of the solution being a mixture of water, surfactants, and other solvents. The zinc ricinoleate is commercially available from suppliers such as Burlington Chemical (Burco DEO 51 NM), ICT Chemicals (Flexisorb OD-300), and Evonik (Tego Sorb A30, Tego Sorb Conc 50).

Sodium Iminodisuccinate

The sodium iminodisuccinate is present in an amount or from about 0.07 to about 2.7 weight percent based on a total weight of the composition. In various embodiments, the sodium iminodisuccinate is present in an amount of from about 0.1 to about 0.5 weight percent based on a total weight of the composition or from about 0.3 to about 0.4 weight percent based on a total weight of the composition. In still other embodiments, the sodium iminodisuccinate is present in an amount of from about 0.2 to about 0.4, from about 0.2 to about 0.3, from about 0.3 to about 0.5, or from about 0.4 to about 0.5, weight percent based on a total weight of the composition. In still other embodiments, the sodium iminodisuccinate is present in an amount of about 1 to about 2.7, from about 1.5 to about 2.5, from about 1.5 to about 2, from about 2 to about 2.5, from about 2 to about 2.7, from about 0.5 to about 2.7, from about 0.5 to about 2, from about 0.5 to about 1.5, or from about 0.5 to about 1, weight percent based on a total weight of the composition. In various non-limiting embodiments, all values, both whole and fractional, between and including all of the above, are hereby expressly contemplated for use herein. The sodium iminodisuccinate is commercially available from suppliers such as Lanxess.

Non-Aqueous Solvent

The non-aqueous solvent is present in an amount of about 2.7 to about 35 weight percent based on a total weight of the composition. In various embodiments, the non-aqueous solvent is present in an amount of from about 5 to about 35, about 10 to about 30, about 15 to about 25, about 15 to about 20, or about 20 to about 25, weight percent based on a total weight of the composition. In other embodiments, the non-aqueous solvent is present in an amount from about 2.7 to about 12, about 2.7 to about 10, about 2.7 to about 5, etc., weight percent based on a total weight of the composition. In various non-limiting embodiments, all values, both whole and fractional, between and including all of the above, are hereby expressly contemplated for use herein.

The non-aqueous solvent is not particularly limited and may be any known in the art. In various embodiments, the non-aqueous solvent is chosen from are glycerol (glycerin), propylene glycol, ethylene glycol, ethanol, and 4C+ compounds. The term "4C+ compound" refers to one or more of: polypropylene glycol; polyethylene glycol esters such as polyethylene glycol stearate, propylene glycol laurate, and/or propylene glycol palmitate; methyl ester ethoxylate; diethylene glycol; dipropylene glycol; sorbitol; tetramethylene glycol; butylene glycol; pentanediol; hexylene glycol; heptylene glycol; octylene glycol; 2-methyl, 1,3 propanediol; xylitol; mannitol; erythritol; dulcitol; inositol; adonitol; triethylene glycol; polypropylene glycol; glycol ethers, such as ethylene glycol monobutyl ether, diethylene glycol monobutyl ether, triethylene glycol monobutyl ether, ethylene glycol monopropyl ether, diethylene glycol monoethyl ether, triethylene glycol monoethyl ether, diethylene glycol monomethyl ether, and triethylene glycol monomethyl ether; tris (2-hydroxyethyl)methyl ammonium methylsulfate; ethylene oxide/propylene oxide copolymers with a number average molecular weight of 3,500 Daltons or less; and ethoxylated fatty acids. In other embodiments, the non-aqueous solvent is a relatively low molecular weight polyethylene glycol (PEG) having a weight average molecular weight of less than about 600 Da, e.g. about 400, such as those having a weight average molecular weight of from about 380 to about 420, Da. In other embodiments, PEG 200, PEG 250, PEG 300, PEG 350, PEG 400, PEG 450, PEG 500, PEG 550, and/or PEG 600 (wherein the numerals represent the approximate weight average molecular weight in Daltons) may be used. Other suitable non-aqueous solvents include ethylene oxide/propylene oxide block copolymers. In various non-limiting embodiments, all values, both whole and fractional, between and including all of the above, are hereby expressly contemplated for use herein.

In some embodiments, the non-aqueous solvent is partially replaced with a water-binding saccharide that is selected from the group of fructose, glucose, sucrose, xylitol, sorbitol, mannitol, erythritol, dulcitol, inositol, adonitol, tagatose, trehalose, galactose, rhamnose, cyclodextrin, maltodextrin, dextran, sucrose, glucose, ribulose, fructose, threose, arabinose, xylose, lyxose, allose, altrose, mannose, idose, lactose, maltose, invert sugar, isotrehalose, neotrehalose, palatinose or isomaltulose, erythrose, deoxyribose, gulose, idose, talose, erythrulose, xylulose, psicose, turanose, cellobiose, amylopectin, glucosamine, mannosamine, fucose, glucuronic acid, gluconic acid, glucono-lactone, abequose, galactosamine, beet oligosaccharides, isomalto-oligosaccharides, xylo-oligosaccharides, gentio-oligoscaccharides, sorbose, nigero-oligosaccharides, palatinose oligosaccharides, fucose, fractooligosaccharides, maltotetraol, maltotriol, malto-oligosaccharides, lactulose, melibiose, raffinose, rhamnose, ribose, high fructose corn/starch syrup, coupling sugars, soybean oligosaccharides, or glucose syrup, and a mixture thereof.

In one embodiment, the non-aqueous solvent is partially replaced with HFCS, which is a blend of approximately 23% water and 77% saccharide. For example, HFCS 55 typically describes a blend of water (about 23%), glucose (about 34%), and fructose (about 42%). However, in a dried form, HFCS 55 contains approximately 55% fructose by weight of dry HFCS. Unless otherwise stated, HFCS used herein refers to a wet blend which contains water, as it is supplied from HFCS manufacturers. However, it should be understood that dry or essentially dry hybrid of monosaccharides (e.g. HFCS), wherein water has been removed partially or completely, can also be used. While pure fructose is very viscous and hard to handle, HFCS is much more diluted and easier to handle. HFCS is also more cost-effective to manufacture.

Water

The composition includes water in an amount such that the single dose laundry detergent composition has a water activity of from about 0.45 to about 0.8 measured at about 25° C., e.g. with an Aqua Lab 4TEV DUO (water activity meter) on the capacitance setting. Those of skill in the art appreciate that the water activity of an aqueous composition is defined as the partial pressure of water in the aqueous composition divided by the saturation pressure of water at the temperature of the aqueous composition. If no temperature is specified, the default temperature is room temperature, e.g. 25° C. The water activity can be determined by placing a sample in a container which is then sealed, and after equilibrium is reached, determining the relative humidity above the sample. The water activity is calculated from the equilibrium relative humidity according to the following equation:

$$\text{Water activity(Aw)}=(\text{Equilibrium relative humidity})/100$$

In this disclosure, the composition includes water in an amount sufficient such that the composition has the aforementioned water activity. In various embodiments, the composition has a water activity of about 0.45 to about 0.5, about 0.5 to about 0.55, about 0.5 to about 0.6, about 0.55 to about 0.6, about 0.6 to about 0.65, about 0.6 to about 0.7, about 0.65 to about 0.7, about 0.7 to about 0.8, or about 0.75 to about 0.8, measured at about 25° C., e.g. with an Aqua Lab 4TEV DUO (water activity meter) on the capacitance setting. In various non-limiting embodiments, all values, both whole and fractional, between and including all of the above, are hereby expressly contemplated for use herein.

Water activity is typically important because it indicates how much available water there is to solvate materials in solution. Water activity is different than % moisture (or the total water content) since this measurement does not differentiate between bound and un-bound water.

Without intending to be bound by any particular theory, it is believed that water activity impacts stability of zinc ricinoleate, wherein a lower water activity typically leads to instability because a low water activity is indicative of less available water being available in the composition to solvate the zinc ricinoleate. Said differently, stability of zinc ricinoleate in compositions typically decreases as water activity decreases because there is less water available for the solvation. The Examples demonstrate that the compositions surprisingly are stable and have low turbidity even when zinc ricinoleate is used in compositions that have low water activity.

Surfactant

The composition includes about 35 to about 75 weight percent of the surfactant based on a total weight of the composition. In various embodiments, the surfactant is present in an amount of from about 45 to about 65 weight percent based on a total weight of the composition or from about 35 to about 70, about 40 to about 65, about 45 to about 60, or about 50 to about 55, weight percent of the surfactant based on a total weight of the composition. In various non-limiting embodiments, all values, both whole and fractional, between and including all of the above, are hereby expressly contemplated for use herein.

The surfactant is not particularly limited and may include any known in the art. The surfactant may be singular or a combination of two or more surfactants. Any one or more of the surfactants used herein may be anionic, cationic, non-ionic, or zwitterionic, or any combination thereof. In one embodiment, the surfactant is a combination of one or more anionic surfactants and one or more non-ionic surfactants.

In various embodiments, suitable surfactants that are anionic include soaps which contain sulfate or sulfonate groups, including those with alkali metal ions as cations. Usable soaps include alkali metal salts of saturated or unsaturated fatty acids with 12 to 18 carbon (C) atoms. Such fatty acids may also be used in incompletely neutralized form. Usable ionic surfactants of the sulfate type include the salts of sulfuric acid semi esters of fatty alcohols with 12 to 18 C atoms, and/or alcohol ethoxysulfates. Usable ionic surfactants of the sulfonate type include alkane sulfonates with 12 to 18 C atoms and olefin sulfonates with 12 to 18 C atoms, such as those that arise from the reaction of corresponding mono-olefins with sulfur trioxide, alpha-sulfofatty acid esters such as those that arise from the sulfonation of fatty acid methyl or ethyl esters, and lauryl ether sulfates.

In other embodiments, suitable surfactants that are cationic may include textile-softening substances of the general formula X, XI, or XII as illustrated below:

(X)

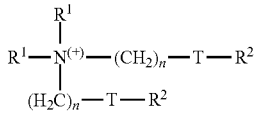

(XI)

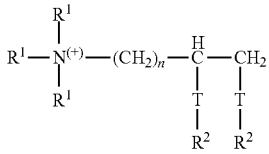

(XII)

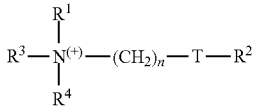

in which each $R^1$ group is mutually independently selected from among $C_{1-6}$ alkyl, alkenyl or hydroxyalkyl groups; each $R^2$ group is mutually independently selected from among $C_{8-28}$ alkyl or alkenyl groups; $R^3$=$R^1$ or $(CH_2)_n$-T-$R^2$; $R^4$=$R^1$ or $R^2$ or $(CH_2)_n$-T-$R^2$; T=—$CH_2$, —O—CO—, or —CO—O—, and n is an integer from 0 to 5.

The surfactants that are cationic may include conventional anions of a nature and number required for charge balancing. Alternatively, the surfactant may include anionic surfactants that may function to balance the charges with the cationic surfactants. In some embodiments, surfactants that are cations may include hydroxyalkyltrialkylammonium compounds, such as C12-18 alkyl(hydroxyethyl)dimethyl ammonium compounds, and may include the halides thereof, such as chlorides or other halides. The surfactants that are cations may be especially useful for compositions intended for treating textiles.

Suitable examples of nonionic surfactants include alkyl glycosides and ethoxylation and/or propoxylation products of alkyl glycosides or linear or branched alcohols in each case having 12 to 18 C atoms in the alkyl moiety and 3 to 20, or 4 to 10, alkyl ether groups. Corresponding ethoxylation and/or propoxylation products of N-alkylamines, vicinal diols, and fatty acid amides, which correspond to the alkyl moiety in the stated long-chain alcohol derivatives, may furthermore be used. Alkylphenols having 5 to 12 C atoms may also be used in the alkyl moiety of the above described long-chain alcohol derivatives.

In other embodiments, the surfactant is chosen from nonionic and ionic surfactants, such as alkoxylates, polyglycerols, glycol ethers, glycols, polyethylene glycols, polypropylene glycols, polybutylene glycols, glycerol ester ethoxylates, polysorbates, alkyl ether sulfates, alkyl- and/or arylsulfonates, alkyl sulfates, ester sulfonates (sulfo-fatty acid esters), ligninsulfonates, fatty acid cyanamides, anionic sulfosuccinic acid surfactants, fatty acid isethionates, acylaminoalkane-sulfonates (fatty acid taurides), fatty acid sarcosinates, ether carboxylic acids and alkyl(ether)phosphates. In such embodiments, suitable nonionic surfactants include $C_2$-$C_6$-alkylene glycols and poly-$C_2$-$C_3$-alkylene glycol ethers, optionally, etherified on one side with a $C_1$-$C_6$-alkanol and having, on average, 1 to 9 identical or different, preferably identical, alkylene glycol groups per molecule, and also alcohols and fatty alcohol polyglycol ethers, preferably propylene glycol, dipropylene glycol, trimethylolpropane, and fatty alcohols with low degrees of ethoxylation having 6 to 22, preferably 8 to 18, more preferably 8 to 12, and even more preferably 8 to 11, carbon atoms. Moreover, suitable ionic surfactants include alkyl ether sulfates, sulfosuccinic acid surfactants, polyacrylates and phosphonic acids, preferably lauryl sulfate, lauryl ether sulfate, sodium sulfosuccinic acid diisooctyl ester, 1-hydroxyethane-1,1-diphosphonic acid, and diacetyltartaric esters.

Additives:

The composition may include one or more of the following additives or may be free of one or more of the following additives. In one embodiment, one or more additional malodor control agents may be used. These may include, antimicrobial agents, cyclodextrins (alpha, beta and gamma) and perfumes (free oil or encapsulated). Typical antimicrobial agents are zinc phenolsulfonate, zinc oxide, zinc chloride, triclosan, etc. One or more perfumes may also be utilized. Non-limiting examples of suitable perfumes include amyl benzoate, beta-caryophyllene, cinnamic alcohol, diphenyl methane, dodecalactone, ethyl methyl phenyl glycidate, eugenol, fenchyl acetate, gamma-n-methyl ionone, heliotropine, indole, isobutyl quinoline, Lilial (p-t-Bucinal), methyl-N-methyl anthranilate, para-methoxy acetophenone, phenethyl butyrate, phenyl heptanol, phenyl hexanol, and phenoxy ethyl propionate. Other optional additives include slip agents, binders, and colorants. Any one or more of the aforementioned additives may be utilized in any amount as chosen by those of skill in the art.

In still other embodiments, one or more active ingredients can be included. Non-limiting examples of active ingredients include, but are not limited to, softening agents, anti-static agents, refreshing agents, fabric conditioning agents, silicones, brighteners, bleaches, antifoams, enzymes, anti-redeposition agents, neutralizers, foam inhibitors, bittering agents, and combinations thereof. It is to be appreciated that various other conventional components may also be included in the composition.

Possible enzymes that may be utilize include one or more of a protease, lipase, amylase, cellulase, pectinase, mannanase, galactanase, xylanase, etc. but others are also possible. In general, the properties of the selected enzyme(s) should be compatible with the composition (i.e., pH-optimum, compatibility with other enzymatic and non-enzymatic ingredients, etc.). The enzyme(s) may be included by adding separate additives containing one or more enzymes, or by adding a combined additive comprising all the enzymes. In various embodiments, the enzyme(s) can be present in effective amounts, such as from 0 weight percent to about 5 weight percent of enzyme, or from about 0.001 to about 1 weight percent, or from about 0.2 to about 2 weight percent, or from about 0.5 to about 1 weight percent, based on the total weight of the composition.

One or more anti-redeposition agents may also be optionally included. Anti-redeposition agents typically include polymers with a soil detachment capacity, which are also known as "soil repellents" due to their ability to provide a soil-repelling finish on the treated surface, such as a fiber. One example in regard to polyesters includes copolyesters prepared from dicarboxylic acids, such as adipic acid, phthalic acid or terephthalic acid. Ethoxylated polyethyleneimines may also serve as effective anti-redeposition agents. The anti-redeposition agent may be present in an amount of from 0 to about 3 weight percent, or an amount of from 0 to about 2 weight percent, or an amount of from 0 to about 1 weight percent, based on the total weight of the composition Neutralizers can also be optionally included in the composition. Exemplary neutralizers include, but are not limited to, sodium hydroxide, triethanol amine, monoethanol amine, buffers, or other compounds that adjust the pH of the composition. Neutralizers may be present in the composition at an amount of from 0 to about 5 weight percent in some embodiments, based on the total weight of the composition, but in other embodiments the neutralizer may be present in the composition at an amount of from 0 to about 3 weight percent, or an amount of from 0 to about 2 weight percent, based on the total weight of the composition.

Foam inhibitors may also optionally be included in the composition. Suitable foam inhibitors include, but are not limited to, fatty acids such as coconut fatty acids. The composition may include the foam inhibitor at an amount of from 0 to about 10 weight percent, based on the total weight of the composition.

Bittering agents may optionally be added to hinder accidental ingestion of the composition. Bittering agents are compositions that taste bad, so children or others are discouraged from accidental ingestion. Exemplary bittering agents include denatonium benzoate, aloin, and others. Bittering agents may be present in the composition at an amount of from 0 to about 1 weight percent, or an amount of from 0 to about 0.5 weight percent, or an amount of from 0 to about 0.1 weight percent in various embodiments, based on the total weight of the composition.

Several other components may optionally be added to and included in the composition in addition to those described above, including but not limited to peroxy compounds, bleach activators, optical brighteners, chelators, dye transfer inhibitors, soil release agents, water softeners, and other components. A partial, non-exclusive list of additional components (not illustrated) that may be added to and included in the composition include electrolytes, pH regulators, graying inhibitors, anti-crease components, bleach agents, colorants, scents, processing aids, antimicrobial agents, and preservatives.

Physical Properties of the Composition:

In addition to the aforementioned water activity, the composition may have one or more of the physical properties described below. In one embodiment, the composition has a turbidity of less than about 25 NTU measured after ageing at about 75° F. for about 24 hours. To determine turbidity, samples can be measured with a HACH Turbidity Meter (model 2100N) at 25° C. by placing a liquid inside of sample vials and inserting into the instrument. The instrument then calculates the NTU (turbidity units) of each sample. In other embodiments, the composition has a turbidity of less than about 10 NTU measured after ageing at about 75° F. for about 6 weeks. In still other embodiments, the composition has a turbidity of less than about 10 NTU measured after ageing at about 105° F. for about 48 hours.

Weight Percents/Ratios of Various Components:

The non-aqueous solvent, the sodium iminodisuccinate, and the zinc ricinoleate are generally present in amounts within the weight ranges set forth above. However, in additional embodiments, these weight ranges may be narrower and/or specific weight ratios may be utilized. These weight ranges and/or ratios may be representative of embodiments that produce special, superior, and unexpected results, such as those demonstrated in the Examples.

In one embodiment, the non-aqueous solvent is glycerin and the glycerin, the sodium iminodisuccinate, and the zinc ricinoleate are present in a weight ratio of about (10 to 12.3):(0.07 to 0.5):0.01, respectively. In another embodiment, the non-aqueous solvent is glycerin and the glycerin, the sodium iminodisuccinate, and the zinc ricinoleate are present in a weight ratio of about (10.3 to 11.5):(0.3 to 0.5):0.05, respectively. In still another embodiment, the non-aqueous solvent is glycerin and the glycerin, the sodium iminodisuccinate, and the zinc ricinoleate are present in a weight ratio of about (3.2 to 6.6):(1.7 to 2.7):0.25, respectively. In a further embodiment, the non-aqueous solvent is glycerin and the glycerin, the sodium iminodisuccinate, and the zinc ricinoleate are present in a weight ratio of about (2.7 to 6.1):(1.7 to 2.7):0.5, respectively. In still another embodiment, the non-aqueous solvent is glycerin and the glycerin, the sodium iminodisuccinate, and the zinc ricinoleate are present in a weight ratio of about (2.7:0.07:0.01) to about (11.6:2.7:0.5), glycerin:sodium iminodisuccinate:zinc ricinoleate. In still a further embodiment, the non-aqueous solvent is glycerin, the sodium iminodisuccinate is present in an amount of from about 0.14 to about 0.3 weight percent based on a total weight of the composition and the zinc ricinoleate is present in an amount of from about 0.01 to about 0.25 weight percent based on a total weight of the composition. In another embodiment, the non-aqueous solvent is glycerin, and the sodium iminodisuccinate is present in an amount of from about 0.07 to about 0.66 weight percent based on a total weight of the composition. In an additional embodiment, the sodium iminodisuccinate and the zinc ricinoleate are present in a weight ratio of about (0.07:0.01) to about (2.7:0.5), respectively. In a further embodiment, the non-aqueous solvent is glycerin and is present in an amount of from about 2.7 to about 11.6 weight percent based on a total weight percent of the composition, the sodium iminodisuccinate is present in an amount of from about 0.07 to about 2.67 weight percent based on a total weight of the composition and the zinc ricinoleate is present in an amount of from about 0.01 to about 0.50 weight percent based on a total weight of the composition. In various non-limiting embodiments, all values, both whole and fractional, between and including all of the above, are hereby expressly contemplated for use herein.

In one embodiment, the non-aqueous solvent is glycerin and the glycerin, sodium iminodisuccinate, and zinc ricinoleate are present in a weight ratio of about (9:0.07:0.01) to about (11.6:0.5:0.25), respectively. In another embodiment, the non-aqueous solvent is glycerin and the glycerin, sodium iminodisuccinate, and zinc ricinoleate are present in a weight ratio of about (2.7:1.6:0.25) to about (6:2.7:0.5), respectively. In a further embodiment, the non-aqueous solvent is glycerin and the glycerin, sodium iminodisuccinate, and zinc ricinoleate are present in a weight ratio of about (2.7:0.07:0.01) to about (6:2.7:0.05), respectively. In various non-limiting embodiments, all values, both whole and fractional, between and including all of the above, are hereby expressly contemplated for use herein.

In another embodiment, the sodium iminodisuccinate and zinc ricinoleate are present in a weight ratio of about (0.07:0.01) to about (0.5:0.25), respectively. In yet another embodiment, the sodium iminodisuccinate, and zinc ricinoleate are present in a weight ratio of about (1.6:0.25) to (2.7:0.5), respectively. In a further embodiment, the sodium iminodisuccinate, and zinc ricinoleate are present in a weight ratio of about (0.07:0.01) to (2.7:0.05), respectively. In various non-limiting embodiments, all values, both whole and fractional, between and including all of the above, are hereby expressly contemplated for use herein.

In a further embodiment, the single dose pack includes the container including the water-soluble film and the composition encapsulated within the container. In this embodiment, the composition includes about 0.01 to about 0.5 weight percent of zinc ricinoleate based on a total weight of the composition; about 0.07 to about 2.7 weight percent of sodium iminodisuccinate based on a total weight of the composition, about 2.7 to about 11.6 weight percent of glycerin based on a total weight of the composition, water; and about 35 to about 75 weight percent of a surfactant based on a total weight of the composition. Moreover, in this embodiment, the composition has a water activity of from about 0.58 to about 0.67 measured at about 25° C. and has a turbidity of less than about 6.5 NTU measured after ageing at about 75° F. for about 24 hours.

Method of Forming Single Dose Pack:

This disclosure also provides a method of forming the single dose pack. The composition is typically first formed, e.g. using shear mixing. Shear mixing may be conducted using an over-the-head mixer such as an IKA RW 20 Digital Mixer at 500 rpm. The composition may then be encapsulated within a container by depositing the composition within the container. The container may then be sealed to encase and enclose the composition within the container to form the single dose pack. The composition is typically in direct contact with the film of the container within the single dose pack. The film of the container is typically sealable by heat, heat and water, ultrasonic methods, or other techniques, and one or more sealing techniques may be used to enclose the composition within the container.

Method of Forming the Single Dose Laundry Detergent Composition:

This disclosure further provides a method of forming the single dose laundry detergent composition. The method includes the step of combining the zinc ricinoleate, the sodium iminodisuccinate, the non-aqueous solvent, the water, and the surfactant to form the single dose laundry detergent composition. Each of the aforementioned components may be combined in any order and in whole or partial amounts. All orders of addition are hereby expressly contemplated for use in various non-limiting embodiments.

EXAMPLES

A series of compositions are formed as set forth below, both representative of embodiments of this disclosure and comparative. Each of the compositions are formed using the following base which makes up 88.2 weight percent of the compositions, as shown in Table 1 below.

TABLE 1

| Description | % in Base Formula (88.2% Base in Compositions) |
|---|---|
| Glycerin | 0.728 |
| C12-C15 Alcohol Ethoxylate 7EO | 23.074 |
| Propylene Glycol | 8.206 |
| Monethanolamine | 3.150 |
| Zeolite Water | 4.567 |
| 2-Phenyl Sulfonic Acid (LAS) | 5.000 |
| Coconut Oil Fatty Acid | 10.000 |
| Sodium C12-C14 Alcohol Ethoxysulfate 3EO (AES) | 26.000 |
| Bitrex | 0.050 |
| Enzyme: Protease | 0.625 |
| Enzyme: Mannanase (0.3%) | 0.3 |
| Enzyme: Amylase (0.3%) | 0.3 |
| Tinopal CBS-X Swiss | 0.200 |
| Sokalan HP20 polymer | 6.000 |
| Subtotal | 88.200 |

The compositions are formed as shown below in Table 2.

TABLE 2

| Comp | Formula | Base | Glycerin | IDS (33% Active Sol'n) | ZnR (50% Active Sol'n) | Wt % Total | NTU | Water Activity |
|---|---|---|---|---|---|---|---|---|
| 1 | Comparative | 88.2 | 11.8 | 0 | 0 | 100 | 4.6 | 0.58 |
| 2 | Comparative | 88.2 | 0 | 11.8 | 0 | 100 | 5.5 | 0.68 |
| 3 | Comparative | 88.2 | 11.78 | 0 | 0.02 | 100 | 100 | 0.58 |
| 4 | Comparative | 88.2 | 11.68 | 0.1 | 0.02 | 100 | 50 | 0.58 |
| 5 | Inventive | 88.2 | 11.555 | 0.225 | 0.02 | 100 | 3.5 | 0.59 |
| 6 | Inventive | 88.2 | 11.33 | 0.45 | 0.02 | 100 | 3.1 | 0.59 |
| 7 | Inventive | 88.2 | 11.205 | 0.575 | 0.02 | 100 | 3.7 | 0.61 |
| 8 | Inventive | 88.2 | 10.88 | 0.9 | 0.02 | 100 | 3.4 | 0.6 |
| 9 | Inventive | 88.2 | 10.58 | 1.2 | 0.02 | 100 | 2.7 | 0.6 |

TABLE 2-continued

| Comp | Formula | Base | Glycerin | IDS (33% Active Sol'n) | ZnR (50% Active Sol'n) | Wt % Total | NTU | Water Activity |
|---|---|---|---|---|---|---|---|---|
| 10 | Inventive | 88.2 | 10.28 | 1.5 | 0.02 | 100 | 2.8 | 0.62 |
| 11 | Comparative | 88.2 | 11.7 | 0 | 0.1 | 100 | 132 | 0.59 |
| 12 | Inventive | 88.2 | 10.8 | 0.9 | 0.1 | 100 | 6.5 | 0.59 |
| 13 | Inventive | 88.2 | 10.35 | 1.35 | 0.1 | 100 | 2.6 | 0.6 |
| 14 | Comparative | 88.2 | 9.9 | 1.8 | 0.1 | 100 | 144 | 0.61 |
| 15 | Comparative | 88.2 | 11.3 | 0 | 0.5 | 100 | 3145 | 0.59 |
| 16 | Comparative | 88.2 | 9.5 | 1.8 | 0.5 | 100 | 99.8 | 0.6 |
| 17 | Inventive | 88.2 | 5.9 | 5.4 | 0.5 | 100 | 1.7 | 0.63 |
| 18 | Inventive | 88.2 | 3.2 | 8.1 | 0.5 | 100 | 1.9 | 0.64 |
| 19 | Comparative | 88.2 | 0.5 | 10.8 | 0.5 | 100 | 1002 | 0.67 |
| 20 | Comparative | 88.2 | 10.8 | 0 | 1 | 100 | 2212 | 0.6 |
| 21 | Inventive | 88.2 | 5.4 | 5.4 | 1 | 100 | 1.9 | 0.64 |
| 22 | Inventive | 88.2 | 2.7 | 8.1 | 1 | 100 | 1.7 | 0.65 |
| 23 | Comparative | 88.2 | 0 | 10.8 | 1 | 100 | 2300 | 0.65 |

In Table 2, the components are as follows:

The term "Comp" refers to Compositions 1-23. Some of the compositions are comparative and some are representative of this disclosure and are labeled inventive.

Base refers to the amount of the base utilized, as described above.

Glycerin is commercially available from Louis Dreyfus under the tradename of USP Glycerin 99.7.

IDS refers to a 33 wt % active solution of sodium iminodisuccinate in water commercially available from Lanxess under the tradename of Baypure CX100.

ZnR refers to a 50 wt % active solution of zinc ricinoleate in water commercially available from Evonik under the tradename of Tego Sorb Conc 50.

NTU refers to the turbidity units as determined as described above.

These compositions are formed and then aged at 75° F. for 24 hours. Subsequently, using a HACH Turbidity Meter, the NTU (Turbidity Units) of each composition is measured. A composition with a NTU value below 10 is considered transparent and stable. The water activity of each composition is also measured at 25° C.

As is shown in Table 2, there are five groupings of data, i.e., one grouping of comparative data and four groupings of comparative/inventive data. The base is held constant at 88.2 wt %, while the glycerin and IDS are varied.

The first group of comparative data (Compositions 1-3) demonstrates that use of glycerin alone or IDS alone still allows solutions to have low turbidity. However, the data also demonstrates that use of glycerin without IDS but with ZnR causes solutions to have high turbidity.

The first group of comparative/inventive data (Compositions 4-10) holds the ZnR constant at 0.02 wt % of a 50 wt % active solution of ZnR in water, which is equal to 0.01 wt % active ZnR. This group of data shows that when too little IDS is used (e.g. 0.1 wt % of a 33 wt % solution of IDS; see Composition 4), the turbidity of the solution is very high (~50). However, when more IDS is used, the turbidity surprisingly drops to very low levels of from 2.7 to 3.7 (see Compositions 5-10). This data also surprisingly shows that by using IDS, lower amounts of ZnR can be successfully used with compositions that have low water activity levels.

The second group of comparative/inventive data holds the ZnR constant at 0.1 wt % of a 50 wt % active solution of ZnR in water, which is equal to 0.05 wt % active ZnR. This group of data shows that when no IDS is used (see Composition 11), then turbidity is very high. Moreover, when too much IDS is used (e.g. 1.8 wt % of a 33 wt % solution of IDS; see Composition 14), the turbidity is also very high (~144). However, when less IDS is used, the turbidity surprisingly drops to very low levels of from 2.6 to 6.5 (see Compositions 12 and 13). This data surprisingly shows that by using IDS, increasing amounts of ZnR can be successfully used with compositions that have low water activity levels.

The third group of comparative/inventive data holds the ZnR constant at 0.5 wt % of a 50 wt % active solution of ZnR in water, which is equal to 0.25 wt % active ZnR. This group of data shows that when no IDS is used (see Composition 15), then turbidity is very high. Moreover, when alternative amounts of IDS are used (e.g. 1.8 wt % or 10.8 wt % of a 33 wt % solution of IDS; see Compositions 16 and 19), the turbidity is also very high (~99.8; 1002, respectively). However, when a medium amount of IDS is used, the turbidity surprisingly drops to very low levels of from 1.7 to 1.9 (see Compositions 17 and 18). This data surprisingly shows that by using IDS, still increasing amounts of ZnR can be successfully used with compositions that have low water activity levels.

The fourth group of comparative/data holds the ZnR constant at 1 wt % of a 50 wt % active solution of ZnR in water, which is equal to 0.5 wt % active ZnR. This group of data shows that when no IDS is used (see Composition 20), then turbidity is very high. Moreover, when too much IDS is used (e.g. 10.8 wt % of a 33 wt % solution of IDS; see Composition 23), the turbidity is also very high (~2300). However, when less IDS is used, the turbidity surprisingly drops to very low levels of from 1.7 to 1.9 (see Compositions 21 and 22). This data surprisingly shows that by using IDS, even further increased amounts of ZnR can be successfully used with compositions that have low water activity levels.

In summary, as shown in Table 2 above, compositions including ZnR with no IDS had NTU values above 100 (in some cases above 2000), whereas samples including a sufficient amount of IDS had values below 10 NTU. Furthermore, samples with excessive amounts of IDS+ZnR also caused instability in the system and created NTU values above 100, 1000 or 2000 depending on the use level. Moreover, and without intending to be bound by theory, it is believed that if more glycerin is added (e.g. in Composition 23), the glycerin would bind additional free water in the composition which would mean that less water would be available to solvate the ZnR thereby even further decreasing stability. Therefore, in examples such as Composition 23, addition of glycerin would not help but would be expected to decrease stability and make performance worse.

The single dose laundry compositions of Table 2 exhibit superior and unexpected results. More specifically, use of particular weight percents of the zinc ricinoleate, the sodium iminodisuccinate, and the non-aqueous solvent produces compositions that surprisingly have low turbidity, especially as compared to compositions that include higher amounts of sodium iminodisuccinate.

In addition, Compositions 3, 6, and 8 are also placed into stability testing. After 6 weeks of aging at 75° F., 105° F., 113° F. and 125° F. (125° F. is only aged for 2 weeks), only Composition 3 has instabilities due to the haziness of the Composition. After 48 hours at 105° F., this haze settles out of the solution completely. Compositions 6 and 8 are translucent and stable across all of the aforementioned temperatures. This data surprisingly shows that by using IDS, a small amount of ZnR can be successfully used with compositions that have low water activity levels and that such compositions can be aged successfully and at high temperatures when such ageing would typically be expected to degrade the compositions such that they have high and unusable turbidities.

An additional comparative example is also evaluated based on the working example set forth in U.S. Pat. No. 8,318,806. More specifically, the following components in Parts A, B, and C are combined. This combination has a water activity of about 0.95.

| | % By Weight |
|---|---|
| Part A | |
| Baypure CX | 12.0 |
| Water | 20.0 |
| Sodium Citrate | 2.0 |
| Tego Sorb PY 88 TQ | 4.0 |
| Part B | |
| Water | 60.0 |
| Part C | |
| Isopropyl Alcohol | 2.0 |

These combined components are then added to the aforementioned Base such that an amount of active ZnR in this comparative example is 0.01 wt %. After combination with the base, the water activity is about 0.6-0.7. After combination and ageing at about 75° F. for about 24 hours, a solution of high turbidity (i.e., visual cloudiness) is observed. This demonstrates that use of Parts A, B, and C of the example of U.S. Pat. No. 8,318,806 does not form a single dose laundry detergent composition that has a turbidity of less than about 25 NTU measured after ageing at about 75° F. for about 24 hours. In short, this comparative example fails.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration in any way. Rather, the foregoing detailed description will provide those skilled in the art with a convenient road map for implementing an exemplary embodiment. It being understood that various changes may be made in the function and arrangement of elements described in an exemplary embodiment without departing from the scope as set forth in the appended claims.

What is claimed is:

1. A laundry detergent composition comprising:

about 0.005 to about 0.5 weight percent of zinc ricinoleate based on a total weight of said composition;

about 0.07 to about 2.7 weight percent of sodium iminodisuccinate based on a total weight of said composition;

about 2.7 to about 35 weight percent of a non-aqueous solvent based on a total weight of said composition;

about 35 to about 75 weight percent of a surfactant based on a total weight of said composition; and water;

wherein said single dose laundry detergent composition has a water activity of from about 0.45 to about 0.8 measured at about 25° C. and has a turbidity of less than about 25 NTU measured after ageing at about 75° F. for about 24 hours.

2. A single dose pack comprising:

a container comprising a water-soluble film; and a single dose laundry detergent composition encapsulated within said container, wherein said single dose laundry detergent composition comprises:

about 0.005 to about 0.5 weight percent of zinc ricinoleate based on a total weight of said composition;

about 0.07 to about 2.7 weight percent of sodium iminodisuccinate based on a total weight of said composition;

about 2.7 to about 35 weight percent of a non-aqueous solvent based on a total weight of said composition;

about 35 to about 75 weight percent of a surfactant based on a total weight of said composition; and water;

wherein said single dose laundry detergent composition has a water activity of from about 0.45 to about 0.8 measured at about 25° C. and has a turbidity of less than about 25 NTU measured after ageing at about 75° F. for about 24 hours.

3. The single dose pack of claim 2, wherein said non-aqueous solvent is glycerin; and wherein said glycerin, said sodium iminodisuccinate, and said zinc ricinoleate are present in a weight ratio of about (10 to 12.3):(0.07 to 0.5):0.01.

4. The single dose pack of claim 2, wherein said non-aqueous solvent is glycerin; and wherein said glycerin, said sodium iminodisuccinate, and said zinc ricinoleate are present in a weight ratio of about (10.3 to 11.5):(0.3 to 0.5):0.05.

5. The single dose pack of claim 2, wherein said non-aqueous solvent is glycerin; and wherein said glycerin, said sodium iminodisuccinate, and said zinc ricinoleate are present in a weight ratio of about (3.2 to 6.6):(1.7 to 2.7):0.25.

6. The single dose pack of claim 2, wherein said non-aqueous solvent is glycerin; and wherein said glycerin, said sodium iminodisuccinate, and said zinc ricinoleate are present in a weight ratio of about (2.7 to 6.1):(1.7 to 2.7):0.5.

7. The single dose pack of claim 2, wherein said non-aqueous solvent is glycerin; and wherein said glycerin, said sodium iminodisuccinate, and said zinc ricinoleate are present in a weight ratio of about (2.7:0.07:0.01) to about (11.6:2.7:0.5), glycerin:sodium iminodisuccinate:zinc ricinoleate.

8. The single dose pack of claim 2, wherein said non-aqueous solvent is glycerin; wherein said sodium iminodisuccinate is present in an amount of from about 0.14 to about 0.3 weight percent based on a total weight of said composition and said zinc ricinoleate is present in an amount of from about 0.01 to about 0.25 weight percent based on a total weight of said composition.

9. The single dose pack of claim 2, wherein said non-aqueous solvent is glycerin; and wherein said sodium iminodisuccinate is present in an amount of from about 0.07 to about 0.66 weight percent based on a total weight of said composition.

10. The single dose pack of claim 2, wherein said sodium iminodisuccinate and said zinc ricinoleate are present in a weight ratio of about (0.07:0.01) to about (2.7:0.5).

11. The single dose pack of claim 2, wherein said non-aqueous solvent is glycerin and is present in an amount of from about 2.7 to about 11.6 weight percent based on a total weight percent of said composition, wherein said sodium iminodisuccinate is present in an amount of from about 0.07 to about 2.67 weight percent based on a total weight of said composition and said zinc ricinoleate is present in an amount of from about 0.01 to about 0.50 weight percent based on a total weight of said composition.

12. The single dose pack of claim 2, wherein said single dose laundry detergent composition has a turbidity of less than about 10 NTU measured after ageing at about 75° F. for about 6 weeks.

13. The single dose pack of claim 2, wherein said zinc ricinoleate is present in an amount of from about 0.005 to about 0.05 weight percent based on a total weight of said composition.

14. The single dose pack of claim 2, wherein said zinc ricinoleate is present in an amount of from about 0.007 to about 0.015 weight percent based on a total weight of said composition.

15. The single dose pack of claim 2, wherein said sodium iminodisuccinate is present in an amount of from about 0.1 to about 0.5 weight percent based on a total weight of said composition.

16. The single dose pack of claim 2, wherein said sodium iminodisuccinate is present in an amount of from about 0.1 to about 0.5 weight percent based on a total weight of said composition.

17. The single dose pack of claim 2, wherein said sodium iminodisuccinate is present in an amount of from about 0.3 to about 0.4 weight percent based on a total weight of said composition.

18. The single dose pack of claim 2, wherein said non-aqueous solvent comprises glycerin.

19. The single dose pack of claim 2, wherein said single dose laundry detergent composition has a turbidity of less than about 10 NTU measured after ageing at about 75° F. for about 6 weeks.

20. A single dose pack comprising:

a container comprising a water-soluble film; and a single dose laundry detergent composition encapsulated within said container, wherein said single dose laundry detergent composition comprises:

about 0.01 to about 0.5 weight percent of zinc ricinoleate based on a total weight of said composition;

about 0.07 to about 2.7 weight percent of sodium iminodisuccinate based on a total weight of said composition;

about 35 to about 75 weight percent of a surfactant based on a total weight of said composition; and water;

wherein said single dose laundry detergent composition has a water activity of from about 0.58 to about 0.67 measured at about 25° C. and has a turbidity of less than about 6.5 NTU measured after ageing at about 75° F. for about 24 hours.

* * * * *